US011242970B2

(12) United States Patent
Juneau

(10) Patent No.: US 11,242,970 B2
(45) Date of Patent: Feb. 8, 2022

(54) VEHICLE LAMP

(71) Applicant: North American Lighting, Inc., Paris, IL (US)

(72) Inventor: John-Michael Juneau, Farmington Hills, MI (US)

(73) Assignee: NORTH AMERICAN LIGHTING, INC., Paris, IL (US)

( * ) Notice: Subject to any disclaimer, the term of this patent is extended or adjusted under 35 U.S.C. 154(b) by 58 days.

(21) Appl. No.: 16/875,536

(22) Filed: May 15, 2020

(65) Prior Publication Data

US 2020/0408375 A1 Dec. 31, 2020

Related U.S. Application Data

(63) Continuation of application No. 16/453,732, filed on Jun. 26, 2019, now Pat. No. 10,655,809.

(51) Int. Cl.

| | |
|---|---|
| ***F21S 41/147*** | (2018.01) |
| ***F21S 41/255*** | (2018.01) |
| *F21Y 115/10* | (2016.01) |

(52) U.S. Cl.

CPC ..... *F21S 41/147* (2018.01); *F21S 41/255* (2018.01); *F21Y 2115/10* (2016.08)

(58) Field of Classification Search

CPC .... F21S 41/147; F21S 41/255; F21Y 2115/10
See application file for complete search history.

(56) References Cited

U.S. PATENT DOCUMENTS

| | | | | |
|---|---|---|---|---|
| 6,722,777 | B2 ‡ | 4/2004 | Erber | F21V 7/0008 362/51 |
| 9,404,638 | B2 ‡ | 8/2016 | Seki | F21V 5/046 |
| 9,625,117 | B2 ‡ | 4/2017 | Saito | F21S 45/48 |
| 9,841,162 | B2 ‡ | 12/2017 | Pickard | F21S 41/145 |
| 9,869,441 | B2 ‡ | 1/2018 | Woodward | F21S 41/336 |
| 2012/0127728 | A1 ‡ | 5/2012 | Chang | F21V 7/0041 362/29 |
| 2015/0124428 | A1 ‡ | 5/2015 | Hadrath | G02B 19/0047 362/84 |
| 2016/0047520 | A1 ‡ | 2/2016 | Suzuki | F21S 41/147 362/514 |
| 2017/0158113 | A1 ‡ | 6/2017 | Kanayama | B60Q 1/0023 |
| 2017/0198877 | A1 ‡ | 7/2017 | Suwa | F21S 41/27 |
| 2017/0227184 | A1 ‡ | 8/2017 | Ishida | F21S 41/147 |

‡ imported from a related application

*Primary Examiner* — Kevin Quarterman
(74) *Attorney, Agent, or Firm* — Brooks Kushman P.C.

(57) ABSTRACT

A vehicle lamp having a light assembly and reflector assembly is provided. The light assembly has a light emitting diode (LED) mounted on a substrate to emit first and second solid angles. A reflective recycling surface is mounted on the substrate adjacent to the LED. The reflector assembly has a first reflector having a macro-focal reflective surface extending at the first solid angle relative to the LED and defines an output light pattern along an output optical axis. A second reflector has an ellipsoid reflective surface extending at the second solid angle relative to the LED and has a first focal point oriented at the LED and a second focal point oriented at the recycling surface. The second reflector reflects light emitted from the LED in the second solid angle back to the recycling surface. The recycling surface reflects light from the second reflector to be incident the first reflector.

20 Claims, 5 Drawing Sheets

(section A-A)

(section A-A)

VEHICLE LAMP

CROSS-REFERENCE TO RELATED APPLICATIONS

This application is a continuation of U.S. application Ser. No. 16/453,732 filed Jun. 26, 2019, now U.S. Pat. No. 10,655,809, the disclosure of which is hereby incorporated in its entirety by reference herein.

TECHNICAL FIELD

The present application relates to a vehicle lamp for emitting light in a predetermined pattern and/or direction.

BACKGROUND

In vehicle lamps, such as headlamps, there is a tradeoff between efficiency and size when designing lighting functions. Large reflectors can have a large solid angle and can be efficient but are expensive and difficult to package in vehicle applications. A small reflector may be easier to package and less expensive to produce. But typically, a small reflector does not have a large solid angle relative to the light source, so only a small amount of the light source output contributes to the reflector's beam pattern.

SUMMARY

According to at least one embodiment, a vehicle lamp is provided having a light assembly that includes a light emitting diode (LED) mounted on a substrate and a reflective recycling surface mounted on the substrate adjacent to the LED. The lamp also includes a reflector assembly positioned rearward of the light assembly and may include: a first reflector defining an output light pattern; and a second reflector having an ellipsoid reflective surface, the second reflector having a first focal point generally oriented at the LED and a second focal point generally oriented at the recycling surface. The lamp also includes where the recycling surface reflects light from the second reflector to be incident the first reflector.

In another embodiment, the substrate is mounted on a mounting flange extending into a lamp chamber.

In another embodiment, the reflective recycling surface and chip of the LED are coplanar.

In another embodiment, the second reflector has a generally parabolic reflective surface.

In another embodiment, the LED emits light in a first and a second solid angle, where the ellipsoid reflective surface reflects light emitted from the first solid angle of the LED back to the recycling surface.

In another embodiment, the recycling surface reflects light from the ellipsoid reflective surface to be incident with the first reflector. The first reflector reflects light emitted from the first solid angle of the LED to define the output light pattern in a forward direction.

In another embodiment, the substrate is mounted adjacent the free distal end. An optical axis of the LED extends rearward toward the reflector assembly.

The optical axis of the LED is oriented generally at an angle of in the range of ten to forty degrees relative to a optical axis of the output light pattern.

In another embodiment, the LED optical axis is oriented at an angle relative to the optical axis of the output light pattern so the LED optical axis is not parallel to the optical axis of the output light pattern.

In another embodiment, the first reflector is an upper reflector positioned above the second reflector.

In another embodiment, the mounting flange may include a heat sink.

According to at least one embodiment, a vehicle lamp is provided having a light emitting diode (LED) mounted in a lamp chamber and oriented to emit light along a central optical axis extending in a rearward direction. The lamp also includes a reflective recycling surface mounted adjacent to the LED. A reflector assembly is positioned reward of the LED and includes a macro-focal reflector. The lamp also includes an ellipsoid reflector where the ellipsoid reflector has a first focal point oriented at the LED and a second focal point oriented at the recycling surface.

According to at least one embodiment, a vehicle lamp is provided having a first reflector mounted in a lamp chamber and configured to define an output light pattern of the vehicle lamp. A second reflector is positioned adjacent the first reflector in the lamp chamber. The second reflector has first and second focal points. A LED is mounted in the lamp chamber at the first focal point of the second reflector and a focal point of the first reflector. The LED is oriented so a first solid angle of LED emitted light is incident on the first reflector and a second solid angle of LED light is incident on the second reflector. A reflective recycling surface is mounted adjacent to the LED at the second focal point of the second reflector. The second reflector reflects light emitted from the LED in the second solid angle back to the reflective recycling surface, and thereby the recycling reflective surface reflects light from the second reflector to be incident on the first reflector.

In another embodiment, the first reflector is an upper reflector positioned above the second reflector.

In another embodiment, an optical axis of the LED extends rearward and the optical axis of the parabolic reflective surface projects forward to define the output light pattern.

DETAILED DESCRIPTION

Figure 1:
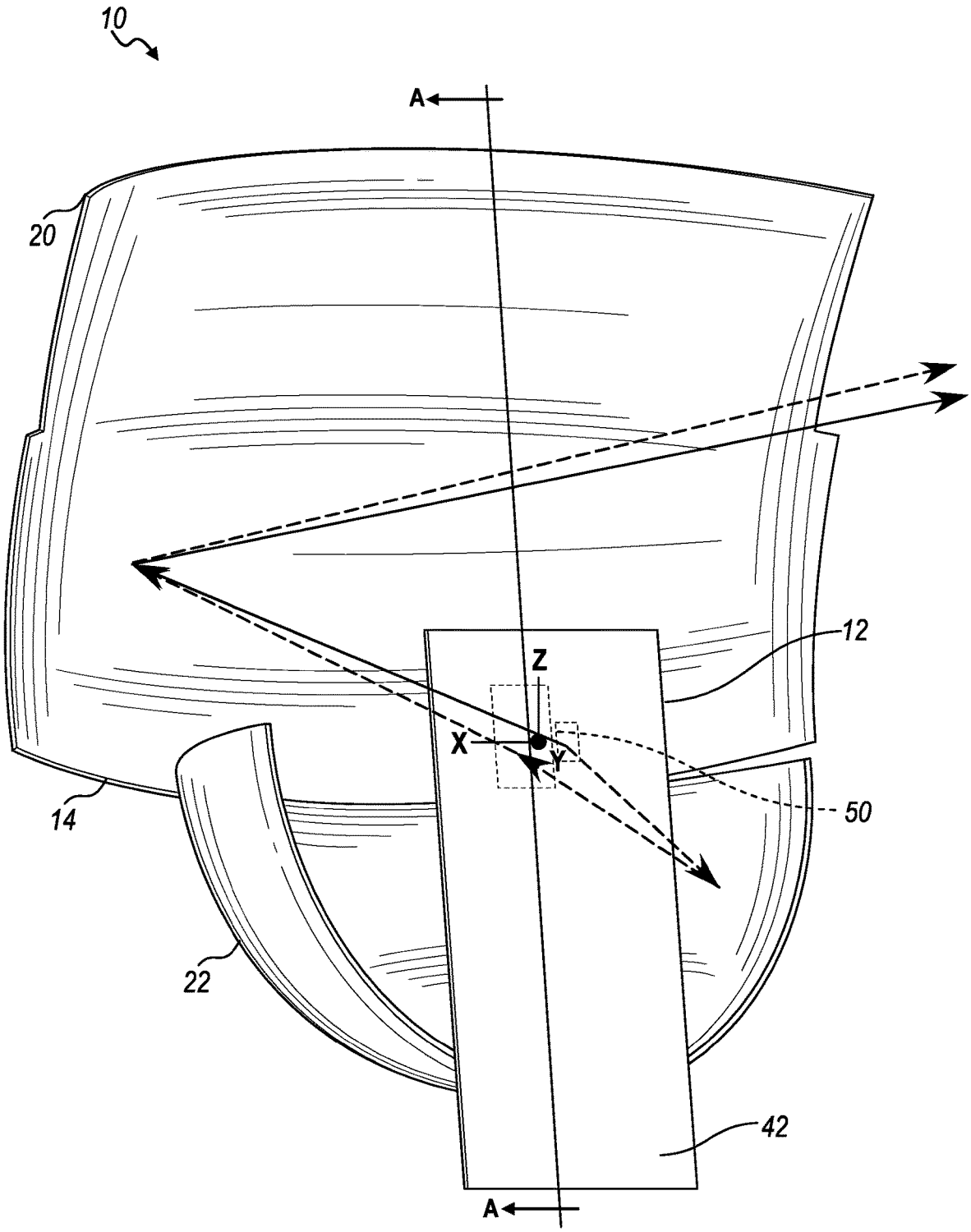
FIG. 1 is a front perspective view of a vehicle lamp according to one embodiment.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

There is a compromise between efficiency and size when designing reflectors for automotive lamps, such as headlamps having forward lighting functions. A large reflector can collect most of the light from a light source to form an output beam pattern, but the size of a reflector is often restricted by packaging limitations in the vehicle. A small reflector will have a small solid angle relative to the light source, so a large amount of light emitted from the light source will miss the reflector. Often, light from vehicle lamps that does not hit the reflector is shielded or blocked to prevent uncontrolled scatter of light which cause problems with glare. If the light that is typically shielded could be effectively directed into the brightest areas of the beam pattern, then a small reflector with a high efficiency could be possible.

The most common automotive reflector design has a light emitting diode (LED) that has a light emitting axis directed downward and a parabolic reflector that directs the light forward into the driver's field of view. The LED emits a hemisphere of light, but it is not possible for this type of reflector to collect and distribute the entire hemisphere of light into the driver's field of view. Light from the LED with a large forward component will not be incident with the reflector. One solution to this problem is to angle the LED backward, which allows the entire hemisphere of light from the LED to be incident with the reflector. However, this solution presents new problems, the main problem being that the LED and its surrounding components block a large amount of the outgoing light from the reflector.

As shown in FIGS. 1-5, the vehicle lamp 10 of the present application reflects the entire hemisphere of light coming from the LED without any of the light being blocked before contributing to the beam pattern. FIGS. 1-5 illustrates a vehicle lamp 10 with light source 12 having a central optical axis 28 projecting backwards, and with a reflector assembly 14 that is oriented to define an output light pattern 16 along an optical axis 18 in a forward direction. The output beam pattern 16 may be a light distribution pattern for a headlamp such as a high-beam pattern or a low-beam pattern. The output beam pattern may also be a foglamp pattern, or other desired vehicle lamp light distribution pattern. The vehicle lamp 10 may have an outer transparent lens disposed over a forward opening. The forward opening and a forward direction define a light emitting direction of the vehicle lamp, regardless of the location of the lamp on the vehicle. A lamp chamber is defined between the lens and reflector 14. The light source is mounted inside the lamp chamber.

As shown in FIGS. 1-5, the reflector 14 is formed of a first reflector 20 and a second reflector 22. The first reflector 20 is an upper reflector is located above the second reflector 22, or lower reflector. The first reflector 20 is macro-focal reflector configured to define the output light pattern of the lamp in the forward direction along an optical axis 18 of the lamp. The macro-focal reflector may have a single focal curve or surface that directs one focal point to a desired direction. The macro-focal reflector may produce a light pattern with a cut-off line, such as in forward lighting applications. As shown in the Figures, the first reflector 20 may have a generally parabolic reflecting surface 24. The second reflector 22 may have a generally ellipsoid reflective surface 26. The parabolic reflecting surface 24 may have facets with parabolic shape. The ellipsoid reflecting surface 26 may have facets with ellipsoid shape.

The light source 12 may be a semiconductor light emitting unit, such as a light emitting diode (LED) in which a rectangular light emitting chip that emits a generally hemispherical light distribution. The light source 12 has central optical axis 28 directed toward the reflector 14. A first portion of the light emitted by the LED is incident on the parabolic reflecting surface 24 and is reflected to define the output beam pattern. The amount of light that the first reflector 20 collects and reflects can be measured as an upper solid angle 30. The other portion of the light emitting from the LED is incident on the second reflector 22. The amount of light that the ellipsoid reflective surface 26 collects and reflects can be measured as a lower solid angle 32. The three-dimensional measure of the amount of light from the light source 12 that is incident on the first reflector 20 and the parabolic reflective surface 24 defines the upper solid angle 30. Similarly, the three-dimensional measure of the amount of light from the light source 12 that is incident on the second reflector 22 and ellipsoid reflective surface 26 defines the lower solid angle 32.

The second reflector 22 and ellipsoid reflective surface 26 has two focal points. The light source 12 is positioned at the first ellipsoid focal point. A small reflective recycling surface 34 is positioned at the second ellipsoid focal point 36. The light emitted from the light source 12 from the lower solid angle 32 is reflected from the second reflector 22 and focused onto the recycling surface 34. The recycling surface 34 acts as a light source and has a light emission pattern similar to the LED. The recycling surface 34 may have a surface area sized similar to the light emitting chip of the LED. In another embodiment, the recycling surface 34 may be approximately 50% larger than the LED in each dimension to enable the recycling reflector 34 to collect any blurred edges or any imperfection in the reflected image of the LED. Light from the recycling surface 34 is 'recycled' and reflected toward the first macro-focal reflector 20. All the light that reflects off the first macro-focal reflector 20 from both the light source 12 and the recycling surface 34 contributes to the output beam pattern without any obstructions.

In one embodiment, approximately half of the light emitted by the light source 12 is emitted directly towards the first macro-focal reflector 20, and approximately half the light emitted from the light source 12 is directed toward the second ellipsoid reflector 22 so the upper solid angle 30 is generally equal to the lower solid angle 32. However, the upper and lower solid angles 30, 32 may vary based on lamp dimensions, packaging constraints, or other design variables.

The first reflector 20 is designed to utilize light from both the upper solid angle 30 and lower solid angle 32 that has been 'recycled' by reflections off the second reflector 22 and the reflective recycling surface 34, to create the output beam pattern. The light from the lower solid angle 32 has been reflected three times so that recycled light exits the lamp chamber in the beam pattern as light from the upper solid angle 30. Therefore, 100% of the light being emitted by the LED hits a reflective surface and is reflected so it contributes to the final beam pattern avoiding the lower solid angle light from being blocked.

Light emitted from the lower solid angle 32 of the LED 12 that is incident on the ellipsoid reflector 22 requires at least two additional reflections before contributing to the output beam pattern. In one example, if each of the ellipsoid surface 26 and recycling surface 34 are 81% reflective, and half of the light from the LED 12 hits the macro-focal reflector 20 directly and half hits the ellipsoid reflector 22, then the final flux from the macro-focal reflector 20 will be 67% of the LED flux. Even with the losses caused by the additional reflections, the output flux of 67% of the LED flux is approximately as high as a larger traditional reflector.

In additional to having high output flux, the ellipsoid reflector 22 has a small overall size. The first macro-focal reflector 20 has a relatively small overall depth D compared to a traditional reflector to produce a similar amount of output flux. The first macro-focal reflector 20 has a depth is approximately equal to the focal length (f). In another example, the depth D may be in the range of 1.0-1.2 f. For comparison, the depth of a traditional reflector with similar efficiency is approximately 3-5 times the focal length. In one example, the depth D may be approximately 20 mm. In comparison, a traditional reflector having the same flux efficiency and focal length would require a depth D of nearly 60 mm or more. However, the reflector depth may vary.

The first macro-focal reflector 20 has a height H in the range of 1.5-2.0 f. In one example, the height H1 may be approximately 30 mm. In comparison, a traditional reflector having the same flux efficiency and focal length would require a height H1 of 50 mm or more. When including the ellipsoid reflector 22, the overall height H2 of the reflector assembly 14 may be approximately 55 mm, in one example. However, the reflector heights and overall height may vary.

Figure 5:
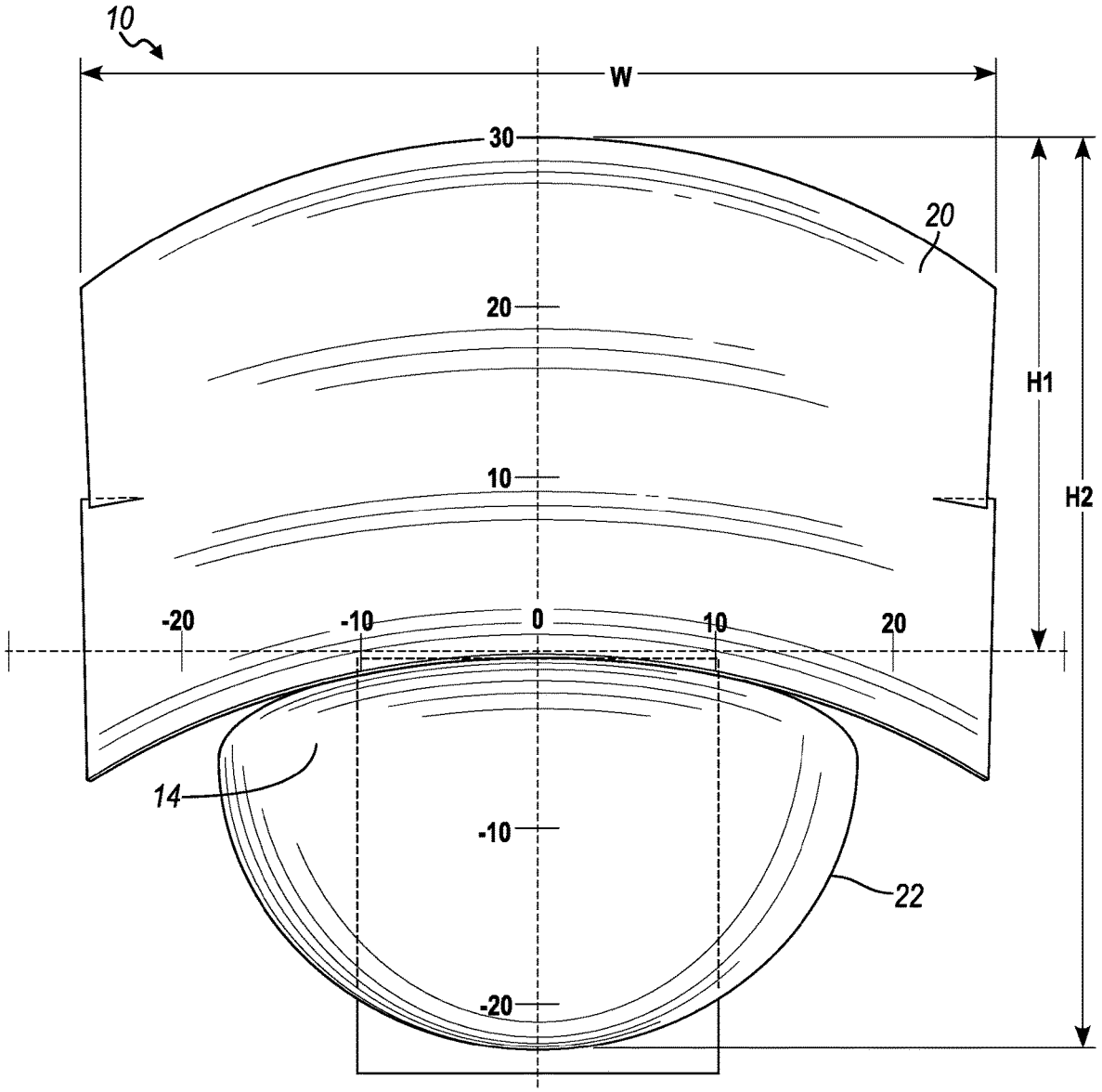
FIG. 5 is a rear view of the vehicle lamp in FIG. 1 or FIG. 3.

As shown in the rear view of FIG. 5, the first macro-focal reflector 20 has a width W in the range of 3-4 f. In one example, the width W may be approximately 50 mm. In comparison, a traditional reflector having the same flux efficiency and focal length would require a width W of 80 mm or more. However, the reflector width may vary. This compact design of the macro-focal reflector is inexpensive to produce due to the small size, low LED count, and simple features while still providing high efficiency.

Figure 2:
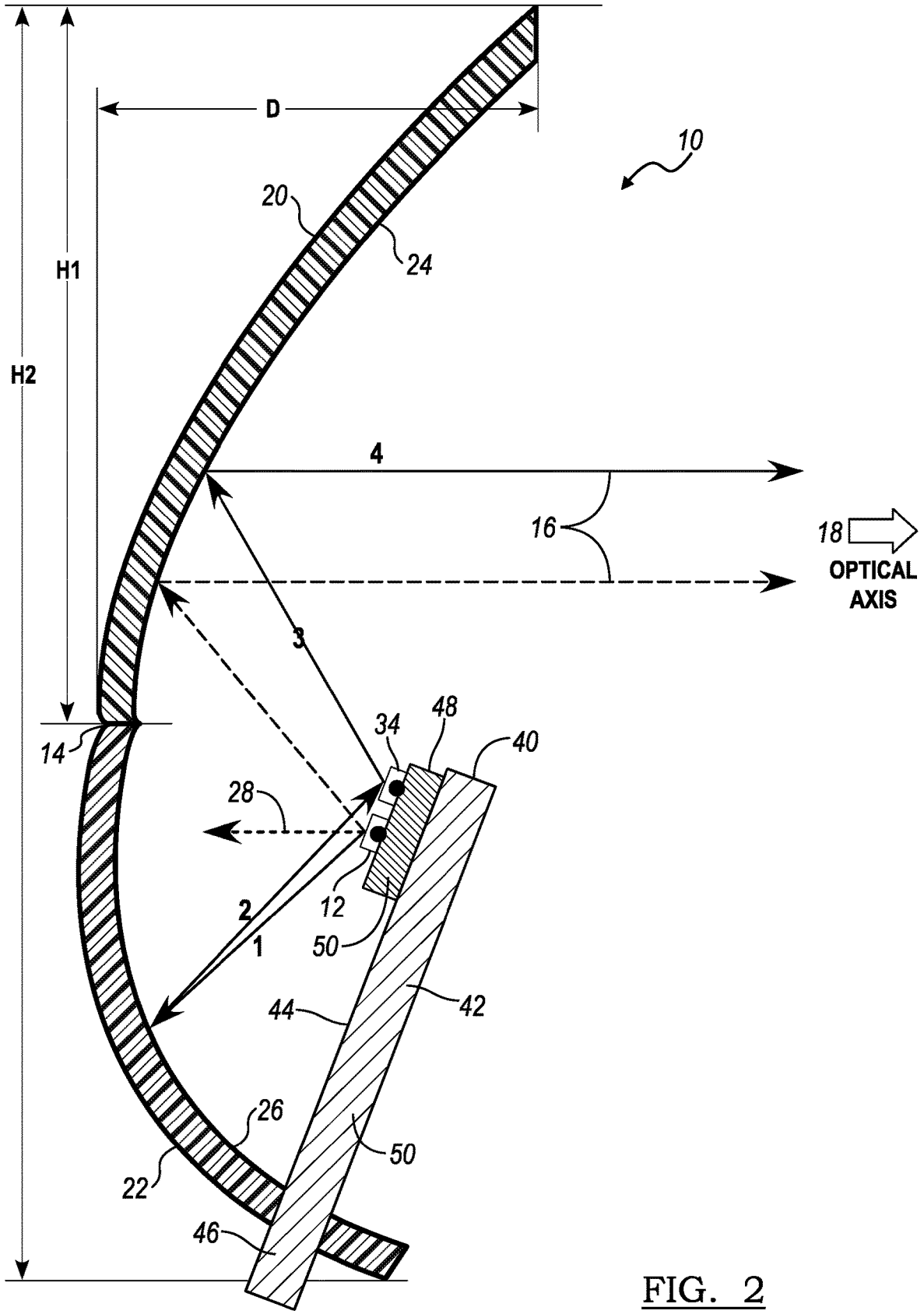
FIG. 2 is a section view through section A-A of the vehicle lamp in FIG. 2 showing a ray trace.
Figure 3:
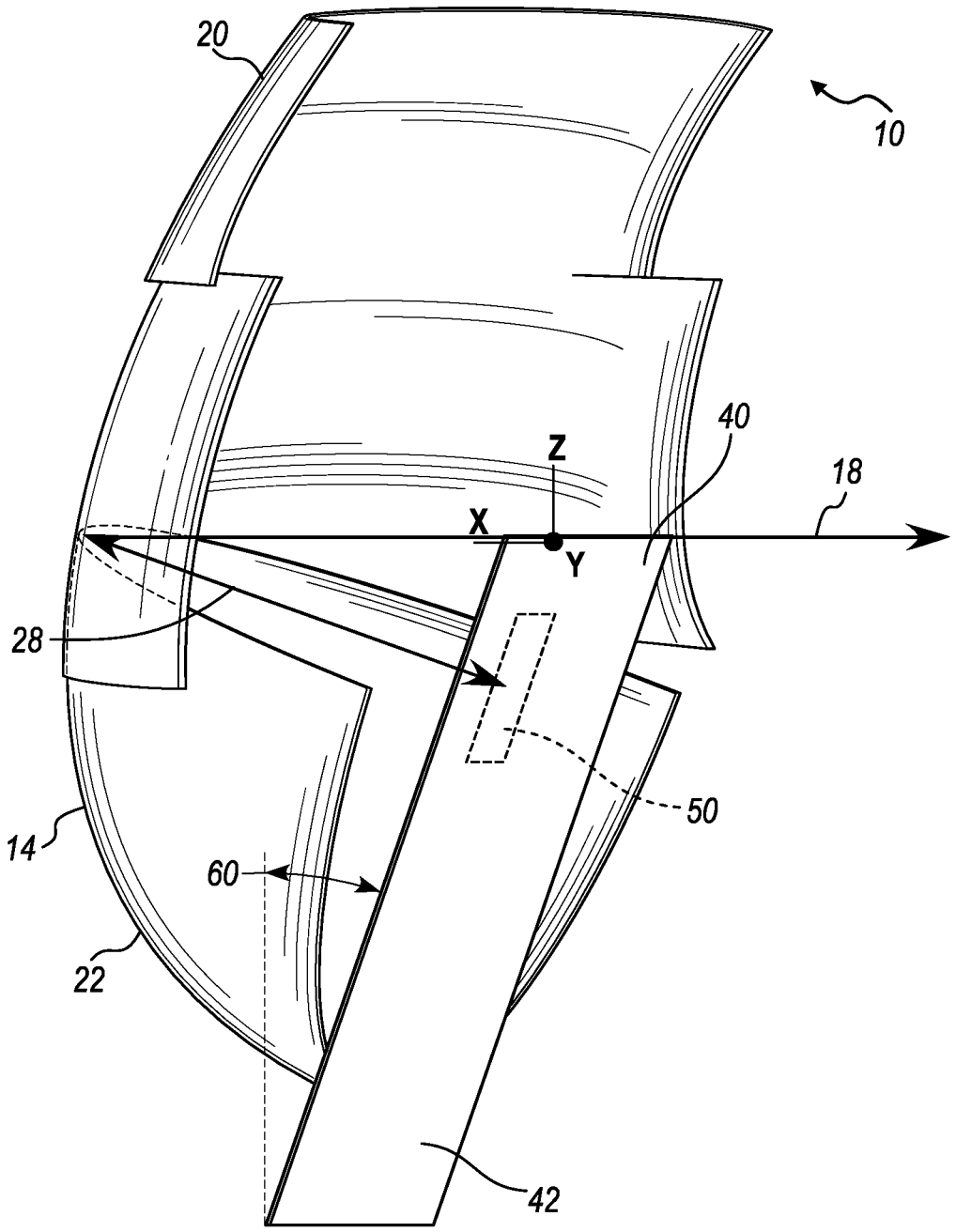
FIG. 3 is a side perspective view of the vehicle lamp according to another embodiment.
Figure 4:
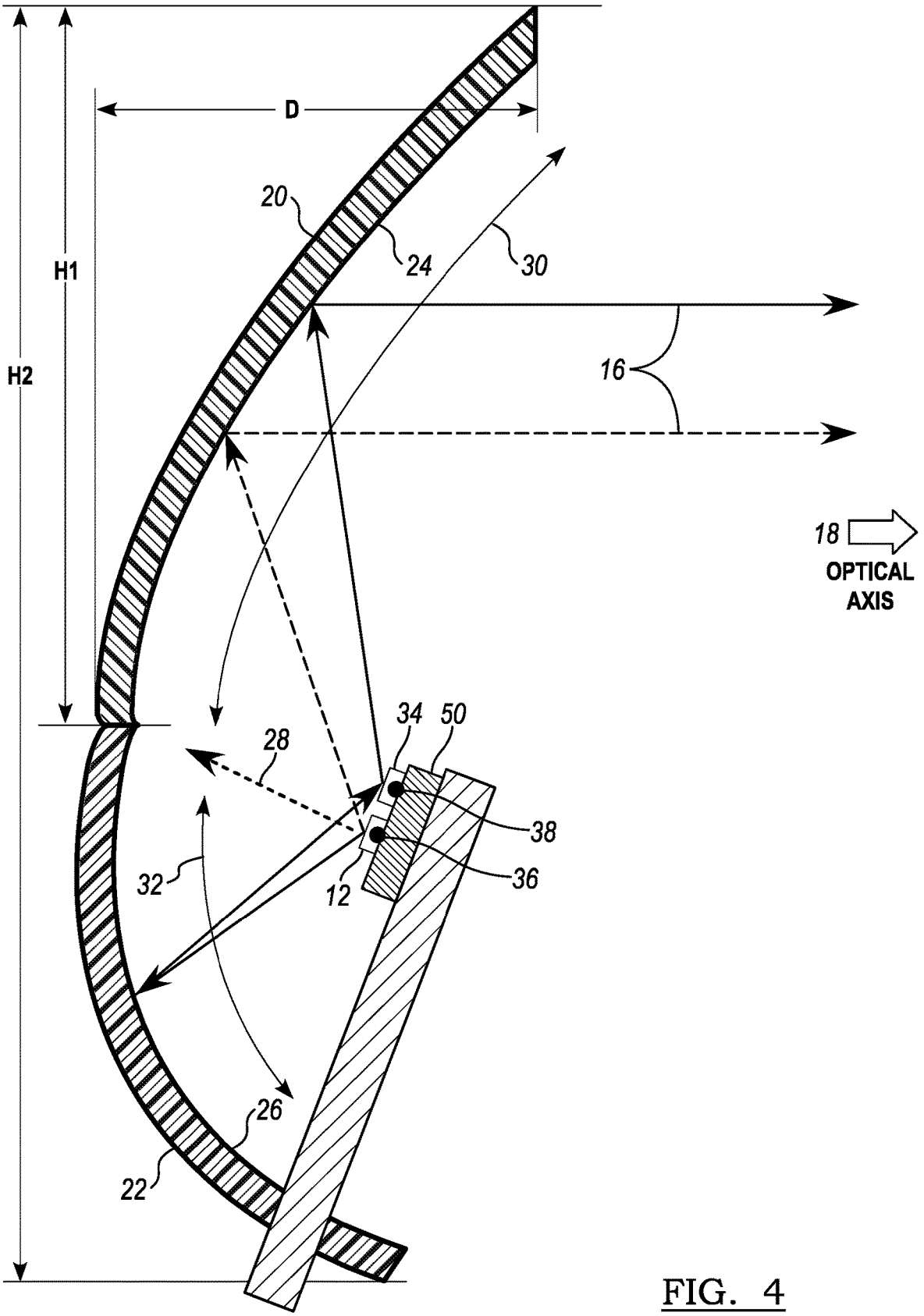
FIG. 4 is a section view of the vehicle lamp in FIG. 3.

As shown in more detail in FIGS. 2-4, the light source 12 is mounted adjacent a distal end 40 of a flange 42 extending into the lamp chamber. The light source 12 is mounted along a rear surface 44 of the flange so the optical axis 28 of the light source 12 is directed backwards toward the reflector 14.

The section view in FIG. 2 is cut through the light source focal point. In this section, the reflective recycling surface 34 is mounted directly above the LED 12 to help ensure that the light that reflects off of the recycling surface 34 does not reflect back into the ellipsoid.

In another embodiment, recycling reflective surface 34 may be below the LED focal or may be positioned horizontally adjacent to the LED or be located adjacent the light source in any suitable direction from the LED focal point. In addition, there may be a plurality of reflective surfaces and recycling reflective focal points on a single recycling reflective surface. In another embodiment, the reflective recycling surface could extend around the entire circumference of the LED. The linear distance between the recycling surface focal point and the LED focal point may be minimized.

The recycling surface 34 is positioned adjacent to the light source 12 along the distal end 40 of the flange 42. The reflective recycling surface 34 and the light source 12 may be mounted on a common substrate 48 to form a light assembly 50. The substrate 48 may include a circuit board such a printed circuit board for providing power and signals to the light source 12.

As shown in FIGS. 2-3, the flange 42 has a first end 46 terminating outside the light chamber and the distal end 40 is a free end that extends into the light chamber. The light source 12 and reflective recycling surface 34 are mounted to the distal end 40 of the flange 42 so the light source 12 and reflective recycling surface 34 are located near the focal point of both the first reflector 20 and second reflector 22. The width and length and shape of the flange 42 may be minimized so the flange 43 does not block any light distribution in the forward direction while still providing enough mechanical stiffness to allow the light source 12 and reflective recycling surface 34 to be mounted stably during vehicle operation. The first end 46 of the flange 42 may be mounted to the lamp housing or a bracket, for example. The flange 42 may include a heat sink. The heat sink may extend to outside the lamp chamber to conduct heat away from light source 12 and lamp chamber. The substrate 48 may be mounted to the heat sink.

To ensure that the flange 42 does not block any of the light reflected from the first reflector 20, the flange 42 may be positioned at an angle 60, as shown in FIGS. 3-4. The angle 60 may be approximately twenty degrees. In another embodiment, the angle 60 may be in the range of ten-degrees to 40-degrees. The angle 60 may be measured from the line being orthogonal to the optical axis 18 of the lamp. The angle 60 of the flange orients the LED optical axis 28 at a similar angle so that the optical axis 28 is not parallel to the optical axis 18 of the lamp. Similarly, the orientation of the recycling surface 34 is coplanar to the LED chip and oriented at the angle 60 along the flange 42. The lower ellipsoid reflector 22 is also oriented at the angle 60. The angle 60 prevents any efficiency losses that may result from the flange 42 blocking the light from the center facets of the first reflector 20.

The light source 12 and the reflective recycling surface 34 are positioned in the light chamber to maximize the combined upper solid angle 30 and lower solid angle 32. The location of the light source 12 may be calculated from the parabolic focal distance of the first reflector 20 and the ellipse focal distance of the second ellipsoid reflector. Different focal distances can be used to allow different light chamber sizes according the vehicle lamp styling requirements.

What is claimed is:

1. A vehicle lamp comprising:

a light assembly comprising:

a light emitting diode (LED) mounted on a substrate;

a reflective recycling surface mounted on the substrate adjacent to the LED;

a reflector assembly positioned rearward of the light assembly and comprising:

a first reflector defining an output light pattern; and a second reflector having an ellipsoid reflective surface, the second reflector having a first focal point generally oriented at the LED and a second focal point generally oriented at the recycling surface, where the recycling surface reflects light from the second reflector to be incident the first reflector.

2. The vehicle lamp of claim 1, wherein the substrate is mounted on a mounting flange extending into a lamp chamber.

3. The vehicle lamp of claim 2, wherein the mounting flange comprises a heat sink.

4. The vehicle lamp of claim 1, wherein the reflective recycling surface and chip of the LED are coplanar.

5. The vehicle lamp of claim 1, wherein the second reflector has a generally parabolic reflective surface.

6. The vehicle lamp of claim 1, wherein the LED emits light in a first and a second solid angle, wherein the ellipsoid reflective surface reflects light emitted from the first solid angle of the LED back to the recycling surface.

7. The vehicle lamp of claim 6, wherein the recycling surface reflects light from the ellipsoid reflective surface to be incident with the first reflector.

8. The vehicle lamp of claim 6, wherein the first reflector reflects light emitted from the first solid angle of the LED to define the output light pattern in a forward direction.

9. The vehicle lamp of claim 1, further comprising a mounting flange having a free distal end extending into a light chamber, wherein the substrate is mounted adjacent the free distal end.

10. The vehicle lamp of claim 1, wherein an optical axis of the LED extends rearward toward the reflector assembly.

11. The vehicle lamp of claim 10, wherein the optical axis of the LED is oriented generally at an angle of in the range of ten to forty degrees relative to an optical axis of the output light pattern.

12. The vehicle lamp of claim 10, wherein the optical axis of the LED is oriented at an angle relative to an optical axis of the output light pattern so the optical axis of the LED is not parallel to the optical axis of the output light pattern.

13. The vehicle lamp of claim 1, wherein the first reflector is an upper reflector positioned above the second reflector.

14. A vehicle lamp comprising:

a light emitting diode (LED) mounted in a lamp chamber and oriented to emit light along a central optical axis extending in a rearward direction;

a reflective recycling surface mounted adjacent to the LED;

a reflector assembly positioned reward of the LED and comprising:

a macro-focal reflector; and an ellipsoid reflector, wherein the ellipsoid reflector has a first focal point oriented at the LED and a second focal point oriented at the recycling surface.

15. The vehicle lamp of claim 14, wherein the LED is mounted on a mounting flange extending into a lamp chamber.

16. The vehicle lamp of claim 15, wherein the recycling surface and the LED are mounted to a common substrate, wherein the common substrate is mounted to the mounting flange.

17. The vehicle lamp of claim 14, wherein the LED emits light in an upper and a lower solid angle, wherein the ellipsoid reflector reflects light emitted from the lower solid angle of the LED back to the recycling surface.

18. The vehicle lamp of claim 17, wherein the recycling surface reflects light from the ellipsoid reflector to be incident with the macro-focal reflector, wherein the macro-focal reflector is generally a parabolic surface.

19. A vehicle lamp comprising:

a first reflector mounted in a lamp chamber and configured to define an output light pattern of the vehicle lamp;

a second reflector positioned adjacent the first reflector in the lamp chamber, the second reflector having first and second focal points;

a light emitting diode (LED) mounted in the lamp chamber at the first focal point of the second reflector and a focal point of the first reflector, the LED oriented so a first solid angle of LED emitted light is incident on the first reflector and a second solid angle of LED light is incident on the second reflector;

a reflective recycling surface mounted adjacent to the LED at the second focal point of the second reflector, wherein the second reflector reflects light emitted from the LED in the second solid angle back to the reflective recycling surface, and thereby the recycling reflective surface reflects light from the second reflector to be incident on the first reflector.

20. The vehicle lamp of claim 19, wherein the first reflector is an upper reflector positioned above the second reflector.

* * * * *